US009874005B2

(12) United States Patent
Krabbe

(10) Patent No.: US 9,874,005 B2
(45) Date of Patent: Jan. 23, 2018

(54) BIDET TOILET HAVING A DAMAGE DEVICE

(71) Applicant: TECE GmbH, Emsdetten (DE)

(72) Inventor: Martin Krabbe, Altenberge (DE)

(73) Assignee: TECE GmbH, Emsdetten (DE)

( * ) Notice: Subject to any disclaimer, the term of this patent is extended or adjusted under 35 U.S.C. 154(b) by 0 days.

(21) Appl. No.: 15/029,424

(22) PCT Filed: Nov. 28, 2014

(86) PCT No.: PCT/EP2014/075953

§ 371 (c)(1),
(2) Date: Jul. 5, 2016

(87) PCT Pub. No.: WO2015/055861

PCT Pub. Date: Apr. 23, 2015

(65) Prior Publication Data

US 2016/0305102 A1 Oct. 20, 2016

(30) Foreign Application Priority Data

Oct. 15, 2013 (DE) ..... 20 2013 104 672 U
Nov. 28, 2013 (DE) ..... 20 2013 105 421 U
Apr. 22, 2014 (DE) ..... 20 2014 101 888 U

(51) Int. Cl.
*A47K 3/20* (2006.01)
*A47K 4/00* (2006.01)
(Continued)

(52) U.S. Cl.
CPC ..... *E03C 1/102* (2013.01); *E03C 1/284* (2013.01); *E03D 9/08* (2013.01)

(58) Field of Classification Search
CPC ..... E03E 9/08
(Continued)

(56) References Cited

U.S. PATENT DOCUMENTS 3,430,267 A 3/1969 Van Houten
3,594,827 A 7/1971 Giacosa et al.
(Continued)

FOREIGN PATENT DOCUMENTS

CH 453242 A 6/1968
DE 19644865 A1 4/1998
(Continued)

OTHER PUBLICATIONS

Int'l Search Report and Written Opinion dated Jul. 31, 2014 in Int'l Application No. PCT/EP2014/057977.
(Continued)

*Primary Examiner* — Lori Baker
(74) *Attorney, Agent, or Firm* — Panitch Schwarze Belisario & Nadel LLP

(57) ABSTRACT

A douche toilet including a toilet bowl having a flushing water connection for feeding flushing water into a flushing chamber defined by the toilet bowl, having a lower end and an upper end delimited by a toilet opening, a drain connection including a primary odor trap for carrying away waste water from the flushing chamber in the course of a flushing operation, a personal cleaning device fed by way of a drinking water line for performing personal cleaning in respect of a user, as well as a safety device for safeguarding a drinking water line is provided. To provide for a compact douche toilet fulfilling the requirements of DIN EN 1717, the safety device includes a damage opening arranged below an upper edge of the toilet opening.

19 Claims, 6 Drawing Sheets

(51) Int. Cl.

| | |
|---|---|
| ***E03D 9/08*** | (2006.01) |
| ***E03C 1/10*** | (2006.01) |
| ***E03C 1/284*** | (2006.01) |

(58) Field of Classification Search
USPC ..... 4/420.5
See application file for complete search history.

(56) References Cited

U.S. PATENT DOCUMENTS

| | | | |
|---|---|---|---|
| 4,136,407 | A | 1/1979 | Maurer |
| 5,715,544 | A | 2/1998 | Huffman et al. |
| 5,742,952 | A | 4/1998 | Huang |
| 7,971,284 | B2 | 7/2011 | Pessel et al. |

FOREIGN PATENT DOCUMENTS

| | | | |
|---|---|---|---|
| DE | 202006013209 | U1 | 11/2006 |
| DE | 102005029609 | A1 | 1/2007 |
| DE | 202013002055 | U1 | 6/2013 |
| DE | 202012005145 | U1 | 8/2013 |
| EP | 0293356 | A1 | 11/1988 |
| EP | 0519885 | A1 | 12/1992 |
| EP | 0530965 | A1 | 3/1993 |
| EP | 1234921 | A1 | 8/2002 |
| EP | 2281957 | A3 | 4/2011 |
| EP | 2447426 | A1 | 5/2012 |
| EP | 1491692 | B1 | 6/2012 |
| FR | 2186039 | A5 | 1/1974 |
| JP | H07224453 | A | 8/1995 |
| WO | 9525205 | A1 | 9/1995 |
| WO | 2012051723 | A1 | 4/2012 |
| WO | 20140102006 | A1 | 7/2014 |

OTHER PUBLICATIONS

Office Action dated Feb. 12, 2014 in DE Application No. 102013207053.5.

Int'l Preliminary Report on Patentability dated Oct. 29, 2015 in Int'l Application No. PCT/EP2014/057977.

European Examination Report dated May 19, 2016 in EP Application No. 14721267.4.

BIDET TOILET HAVING A DAMAGE DEVICE

CROSS-REFERENCE TO RELATED APPLICATIONS

This application is a Section 371 of International Application No. PCT/EP2014/075953, filed Nov. 28, 2014, which was published in the German language on Apr. 23, 2015, under International Publication No. WO 2015/055861 A3 and the disclosure of which is incorporated herein by reference.

BACKGROUND OF THE INVENTION

The invention concerns a douche toilet including a toilet bowl having a flushing water connection for feeding flushing water, a flushing chamber defined by the toilet bowl, having a lower end and an upper end delimited by a toilet opening and which is usually closable by a toilet lid, a drain connection usually including an odor trap, normally in the form of a toilet syphon, for carrying away waste water from the flushing chamber in the course of a flushing operation, a personal cleaning device fed by way of a drinking water line for performing personal cleaning in respect of a user. Finally such a douche toilet also requires a safety device for safeguarding the drinking water network from the ingress of contaminated foul water in accordance with DIN EN 1717, which frequently is also simply referred to as "backflow protection".

Douche toilets of that kind are frequently to be found in the Asian area and are now also increasingly widespread in Europe. Such a douche toilet virtually combines the function of a regular toilet and a bidet in one sanitary appliance or sanitary unit, thereby affording novel creative design options in the bathroom. For the purposes of personal cleaning which can thus be effected by sitting on the toilet bowl it is only necessary to operate one actuating unit so that the flushing water line which usually carries drinking water supplies water to the flushing lance.

Hitherto there are various concepts for integration of a flushing lance into a toilet or toilet bowl, but these are usually relatively complex and require attachment or installation on the toilet bowl or in the wall or the false wall behind the toilet bowl. In addition those products are relatively costly. A simple and inexpensive solution is desirable, which thus also helps that technology to make a market breakthrough in Europe, which therefore in particular involves a complex structure. The market is increasingly demanding that the bidet and the toilet bowl are matched to each other in design, which means in particular that the toilet cannot or should not be markedly longer than the bidet. As far as possible an appliance should be provided, which is integrated into a normal toilet bowl and which can be offered on the market at a good price.

For safeguarding the drinking water line which on the one hand supplies the system with flushing water for the flushing operation but on the other hand also supplies the flushing lance with drinking water, DIN EN 1717 must be taken into consideration at least for products used in Europe. That standard requires measures within a sanitary appliance, which prevent contaminated water from being drawn back into a drinking water line, for example water contaminated with feces from the flushing chamber of the toilet bowl. For that purpose DIN EN 1717 provides various measures, for example a free outlet, or a pipe interrupter. A drinking water draw-off point must generally be such that contamination of the drinking water system cannot occur. That also applies if a reduced pressure should occur in the drinking water line or if the foul water rises in the sanitary appliance (safeguard against non-drinking water being sucked or pressed back). As the toilet is connected directly to the sewerage system the strictest rules apply in that respect. Contamination of the drinking water system must always be excluded even in a damage situation. Simple mechanical backflow prevention devices or backflow flaps are therefore not reliable. System separation between drinking water and non-drinking water must always be effected by way of a free outlet. A safety distance of at least 20 mm must always be observed between that free outlet and the highest possible water level in a sanitary device. That spacing applies even when the outlet is blocked and with at the same time water flowing thereto or in the event of waste water being pushed back out of the foul water line. The highest possible water level in a toilet is in that case the toilet opening which is normally closeable by a toilet lid with toilet seat. To sum up therefore DIN EN 1717 requires technical measures for preventing foul water from being sucked back into the drinking water line in the event of a pressure drop, which is summarized by the key word of "back-suction safeguard".

That problem of back-suction safeguard was already addressed in one of the first patent applications in this area of technology, more specifically in DE 1129896 dating from the year 1957, in which the safeguard was achieved in a complicated fashion by a free outlet into a container and a downstream-connected pump for again building up a pressure. Another solution without a pump with an injector is proposed in CH 444076 dating from the year 1965. In that solution leakage water which can always occur with that kind of safety device is passed into the flushing chamber over the top edge of the toilet pan.

In other countries different technologies are used for resolving the problems outlined in the opening part of this specification, in which respect DIN EN 1717 does not have to be taken into account in Asia. In the United States "vacuum breakers" are preferably employed, which are frequently integrated in an attachment device on the top side of the pan, constituting "technical unit in the lid". The relatively high mounting locations of the toilet lid, which are linked to those solutions, involve toilets of a longer design configuration, which is not always desirable.

In existing douche toilets the height of the toilet opening defines the overflow edge for the foul water in a damage situation, that is to say therefore the highest possible level of foul water in the toilet bowl. As in accordance with DIN EN 1717 a minimum spacing 2 cm between that highest possible level of foul water in a damage situation and a water outlet opening fed by drinking water is required existing safety devices are always arranged at least 2 cm above the toilet opening. That is effected either in a—relatively ugly—cistern or structure between the toilet and the wall or false wall behind the toilet or in the false wall behind the toilet, as described for example in German patent application DE 100 05 254. The mounting complication and expenditure on site is however considerable with such a solution.

Taking that state of the art as its basic starting point, the object of the invention is to at least partially avoid those disadvantages and in particular to provide a compact douche toilet which fulfills the requirements of DIN EN 1717.

BRIEF SUMMARY OF THE INVENTION

In accordance with the invention in a douche toilet of the kind set forth in the opening part of this specification that object is already attained in that the safety device includes a damage opening arranged in the toilet bowl below an upper edge of the toilet opening.

The invention thus provides a particularly compact and simple solution in the form of a damage opening with a connection to atmosphere, which lowers the highest possible foul water level in such a way that back-suction into the drinking water line is excluded under all circumstances. Because this involves a damage opening which is "lowered" in relation to the toilet opening it can be easily integrated into any regular toilet pan or any regular toilet, including for retro-fitment, so that no additional attachment, conversion or the like operation is required for additional pieces of equipment. Thus the damage opening can be arranged for example concealed behind the flushing edge in the toilet. If the foul water level should rise in the flushing chamber due to a blockage or the like then that foul water can drain away into the surrounding space by way of the lowered damage opening so that a rise into the region of the drinking water feed is reliably excluded.

Preferably the damage opening extends in a plane substantially parallel to the horizontal, that is to say displaced downwardly from the plane defined by the toilet opening.

To satisfy the requirements of DIN EN 1717 the damage opening is preferably arranged at least 2 cm below the drinking water outlet, for example below an injector nozzle.

In a preferred embodiment the safety device including the damage opening is arranged behind the primary odor trap, which is preferably in the form of a syphon, of the toilet bowl, that is to say in the end of the toilet which is between the toilet opening and the wall, that is to say rearwardly in the installation position.

Positioned below the drinking water outlet opening which is safeguarded in accordance with DIN EN 1717 however the damage opening can additionally also function as a leakage water catch device which catches leakage water which inevitably escapes on such devices. For that purpose the damage opening is arranged below the drinking water outlet opening in a funnel-shaped configuration.

According to the invention there can be provided a connecting element for feeding leakage or foul water from other regions of the toilet to the damage opening, that is to say for example to permit a discharge flow of leakage water which possibly issues from the flushing lance or in some other form, so that it does not drain away into the flushing chamber of the toilet but by way of the connecting element into the drain connection. That can be effected for example by a leakage line which feeds foul or leakage water from any location of the toilet to the safety device, without influencing the configuration of the toilet. For example that leakage line can be in the form of a hose or can be integrated into the toilet pan or can be in the form of a combination thereof. That leakage line however can also be in the form of a damage line, that is to say to feed water from an overflow or a damage opening arranged separately from the safety device in the flushing chamber of the safety device, more specifically also completely independently of the design configuration of the toilet.

To carry out the function according to the invention the proposed damage opening can be of differing configurations, for example it can be in the form of a simple opening in a leakage line which extends from the personal cleaning device to the safety device, or also in the form of a plane defining a receiving cross-section for catching leakage water from a DIN EN 1717 device, for example an injector, for catching that leakage water, it then preferably being enlarged, that is to say being of a funnel-shaped configuration.

The safety device can include an odor trap which is associated with the damage opening—and which is a secondary trap—and which prevents the issue of odors from a drain connection which is disposed downstream. The preferred configuration of the odor trap is in the form of a syphon which is particularly preferably arranged downstream of the primary or toilet syphon in the drain of the toilet and according to the invention is referred to as the "secondary syphon".

Hitherto leakage water discharge of existing douche toilet safety devices is effected therefore downstream from the toilet or primary syphon, more specifically in accordance with the requirements of DIN EN 1717 at a spacing of at least 20 mm above the upper edge of the flushing chamber between the highest possible water level in the damage situation and the drinking water feed. Consequently the solutions in the state of the art require superposed structures in respect of the height of the toilet above the toilet edge, which make same appear very massive. In most cases those structures are made of plastic. The corners and edges which are formed between such plastic claddings and the toilet pan body are difficult to clean. Usually deposits of dirt occur with time at those transitions and that therefore results in hygiene problems. In contrast thereto the invention involves an entirely novel way by arranging the safety device either downstream of the primary or toilet syphon or at another location in the toilet, in which case then the foul or leakage water is fed by the damage opening to the safety device.

In the case of an embodiment which is optimized in terms of structural space the damage opening is formed by a funnel which can feed leakage water to a syphon in the form of a ring syphon which either surrounds the drain connection in closely adjoining relationship at the outside or which is integrated in or on same. This embodiment is preferably used in that respect in particularly constricted structural configurations as occur for example in the rear end of a toilet, preferably a douche toilet, in which the funnel functions not only as a damage opening but at the same time also catches leakage water from the flushing lance or douche lance.

Particularly simple installation of the damage device in various toilets, in particular douche toilets, can be implemented by designing the funnel in the form of an offset funnel which, besides the actual funnel member, includes a feed conduit for feeding the leakage water caught by the funnel to the drain connection. That offset funnel is geometrically adapted to the respective installation situation in such a way as to be optimized in terms of structural space, so that only offset funnels which are adapted in different ways have to be used for different toilets, and that reduces the number of variants and the storage costs.

Preferably that offset funnel provides a fall from the funnel to the drain connection, which for example can be effected by a transverse channel which is equipped with a fall in the installation position and the longitudinal axis of which extends transversely relative to the longitudinal axis of the drain connection.

To simplify mounting and maintenance fixers for releasable fixing are preferably provided between the offset funnel and the drain connection, for example in the form a latch, particularly preferably in the form of releasable latching tongues. Preferably those fixers also provide a sealing connection between the components.

The invention thus permits entirely novel design concepts for the toilet, because the operating elements for personal cleaning are no longer arranged in ergonomically detrimental fashion behind the back of the user and relatively high on the toilet, as in the state of the art, or have to be implemented with electronic remote controls in a complicated and expensive fashion. By the provision of a leakage conduit for returning the leakage water into the region of the drain connection behind the toilet syphon the operating elements for the douche toilet can now be arranged in ergonomically optimized fashion forwardly, that is to say away from the wall on the toilet bowl and further downwardly. For the first time that measure can provide that the operating elements are arranged on the toilet in any desired fashion and in that respect also in ergonomically optimized manner.

Preferably personal intimate flushing can be effected by a lever, preferably by an actuating device integrated in the toilet, in particular a sanitary cartridge which is laterally integrated at the rear into the toilet for switching on/off and/or mixing water with an operating lever which can also include a plurality of operating elements, for example one for adjusting the water temperature of the water for the flushing lance by a thermostat cartridge, for example arranged at a first side of the toilet, and a further one for regulating quantity and for switching the douche function on and off, arranged for example on the opposite side of the toilet. The need for an additional technology box behind or laterally of the regular toilet is thus completely removed.

The flushing lance is preferably operated hydraulically, in which case the inflowing flushing water presses a longitudinally displaceable lance within a lance housing into the extension position against a compression spring and that compression spring moves the lance back into the retracted rest position again after the water pressure subsides.

To permit simple fitment and removal of the flushing lance in and from the toilet the flushing lance is preferably adapted to be installed from the inside of the toilet, this therefore being possible without removing the toilet from the wall. Preferably that is effected by a union nut which closes the lance housing at the front end and includes a through opening for the actual slider of the flushing lance.

Leakage water from the flushing lance can thus also drain away by way of the connecting element and the damage opening permits a discharge at any time of accumulated water in the case of a blockage with a sufficient spacing below the outlet opening of the drinking water in order to meet the requirements of DIN EN 1717 by way of a discharge into the room.

Preferably the douche toilet according to the invention is in the form of a wall-hung toilet which is fixed with a rear side to a wall, wherein that wall can be in the form of a regular wall or a lightweight wall structure or false wall made up from shaped frame members. In that respect further units for operation of the douche toilet can be arranged in the wall, for example an odor suction removal device or an optional through-flow heater if a separate warm water conduit should not be present.

Thus various design configurations of the toilet can be implemented adapted to the respective installation situation so that the invention affords the possibility of making up a modular concept with which various markets can be serviced and easily adapted with various embodiments.

In the preferred embodiment the douche toilet includes a cold water and a separate warm water conduit which are connected to a thermostat cartridge and which can be adjustably mixed therein for operation of the flushing lance. The flushing water which is mixed in that way (=pipe or drinking water) then passes through an injector forming the DIN EN 1717 safeguard. Quantitative regulation is effected at same preferably by a rotational valve. The output line from the injector is connected to the flushing lance and the damage opening is preferably arranged in the form of a funnel beneath the injector, preferably at a spacing of greater than 2 cm, and thus catches any issuing leakage water and passes that into the drain connection after the toilet or primary syphon.

A simplified embodiment of the douche toilet can be designed without the thermostat cartridge. In this embodiment which is preferably used in warmer climes only cold water is employed for operation of the flushing lance.

This simplified structure however also provides that the leakage water which possibly issues from the DIN EN 1717 safeguard means is fed to the damage opening and possibly a second or secondary odor trap disposed downstream thereof, into the sewerage line.

The combination of a drinking water safeguard, preferably in the form of an injector, with a preferably concealed separate damage or leakage water opening and the connection thereof to the sewerage line by way of a safety device with the foul water opening has numerous advantages:

the operating elements for the first time can be positioned in ergonomically optimized fashion beneath the toilet pan surface;

leakage water possibly issuing from the safeguard does not visibly pass into the toilet bowl; in that respect no "inflow marks" can occur;

the DIN EN 1717 safeguard can be disposed in a fitment housing so that same is also accessible from the exterior (for example for cleaning or maintenance) after the toilet pan is fitted to the wall, without the toilet pan having to be taken down;

the fitment procedure on the part of the installer does not differ from the fitment of a conventional toilet so that no training is required; and all safeguard components are integrated into the toilet pan or into the toilet completely and in operator-optimized fashion.

The personal cleaning device preferably includes a flushing lance which is arranged relatively moveably in a lance housing and which is preferably relatively moveable by water pressure from a retraction position within the lance housing into an extension position in the interior of the flushing chamber, and includes at least one water outlet opening for personal cleaning of the user, which is preferably arranged at the front end of the flushing lance. In a simplified embodiment however the personal cleaning device can also be for example in the form of a simple nozzle at the rear end of the flushing edge on the toilet.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

DETAILED DESCRIPTION OF THE INVENTION

Figure 1:
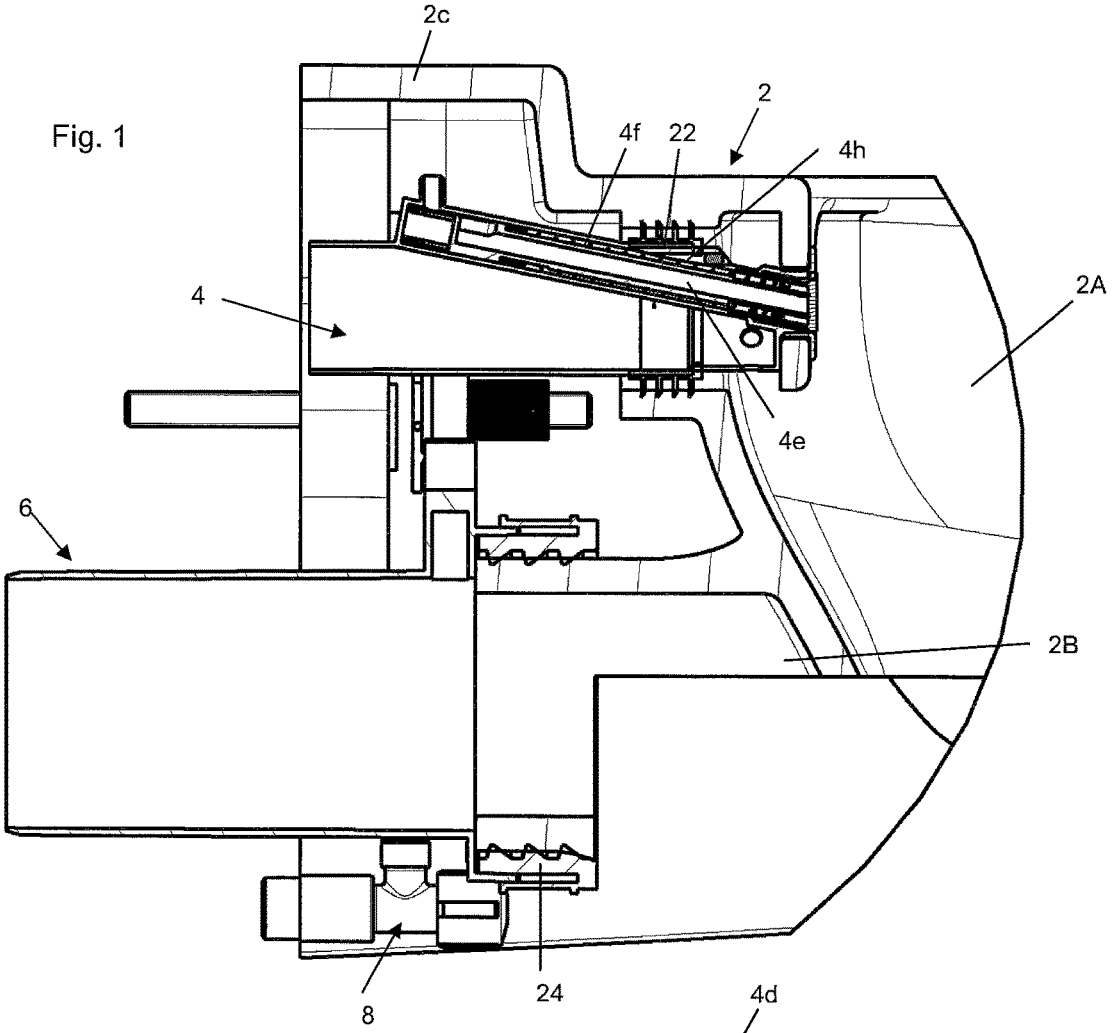
FIG. 1 shows a shows a longitudinal section of the rear end of the douche toilet.

Identical or corresponding components are denoted by the same references.

The proposed douche toilet is substantially formed by a toilet bowl 2 of ceramic, into which a flushing water connection 4 in the form of a flushing water connection portion 4*a* is sealingly inserted at the rear side for feeding flushing water from a cistern which is arranged behind the wall and which is connected to the flushing water connection portion 4*a* by way of a flushing pipe (not shown), which cistern is preferably installed in the form of a concealed cistern in the wall. In a flushing operation the flushing water flows into the flushing chamber 2*a* defined by the toilet bowl 2 by way of the flushing water connection portion 4*a* and flows out of same by way of a toilet or primary syphon 2*b* provided in the lower end of the toilet bowl 2, through the waste water connection 6 in the form of a drain connection portion 6*a*, into the discharge flow pipe. The primary syphon 2*b* therefore in known fashion prevents odors from flowing out of the waste water conduit into the toilet bowl 2 or the douche toilet by virtue of the water contained in the lower bend after the flush.

The flushing water connection portion 4*a* and the drain connection portion 6*a* are both in the form of respective hollow-cylindrical injection moldings which with their front ends—as viewed in the installation position—can be releasably and sealingly inserted into a receiver of a suitable configuration at the rear side of the toilet bowl 2, by a respective sealing cuff 22, 24 in the shape of a circular ring.

The drinking water supply for the flushing lance is provided by way of a cold water connection in the form of an angle valve 8. Besides that cold water connection there can also be a warm water connection for supplying the flushing lance with warm water.

Arranged downstream of the primary syphon 2*b* and between the top side of the drain connection portion 6*a* and the flushing water connection portion 4*a* is the connecting element according to the invention which in the present preferred embodiment is integrated into the drain connection portion 6*a*. The connecting element includes a receiving connection portion 6*j* which is shaped in one piece at the top side of the drain connection portion 6*a* and which in the present case of a rectangular cross-section. Fitted into that receiving connection portion 6*j* is an insert element 6*b* which is of a configuration corresponding to the geometry of the receiving connection portion 6*j* and it can be inserted into the receiving connection portion 6*j* to such an extent until a limb 6*c* projecting radially outwardly approximately at the center of the insert element 6*b* comes to bear against the top side of the receiving connection portion 6*j*. At its top side the insert element 6*b* has a connecting connection portion 6*d* on to which can be fitted a connecting pipe which with its other end is connected to the other side of the flushing water connection portion 14*a* by way of a hose nipple. By virtue of the insert element 6*b* which is inserted into the receiving connection portion 6*j*, formed between those components is a secondary syphon, by virtue of internal walls which correspondingly mutually engage over each other, to prevent the issue of unwanted odors from the drain connection portion 6*a*. Besides the internal walls of the receiving connection portion 6*j* and the insert element 6*b*, which mutually engage behind each other in the installation position, provided at the upper end of the insert element 6*b* is a damage opening 6*e* which is screened off towards the interior by a vertical limb 6*f* and by way of which water flowing through the primary syphon 2*b* and the drain connection portion 6*a* can issue into the surrounding space if a blockage should occur. In that way the requirements of DIN EN 1717 are fulfilled with surprisingly simple features, that is to say back-suction of contaminated water into the water line is prevented.

In the present preferred embodiment the connecting element between the flushing water connection 4 and the drain connection 6 with the damage opening is at least partially formed in one piece by shaping on the drain connection portion 6*a*. That however is not necessarily required for carrying the invention into effect; rather, it is also possible to simply provide a connection in the form of a pipe or hose with a corresponding damage opening between the flushing water connection and the drain connection.

Figure 2:
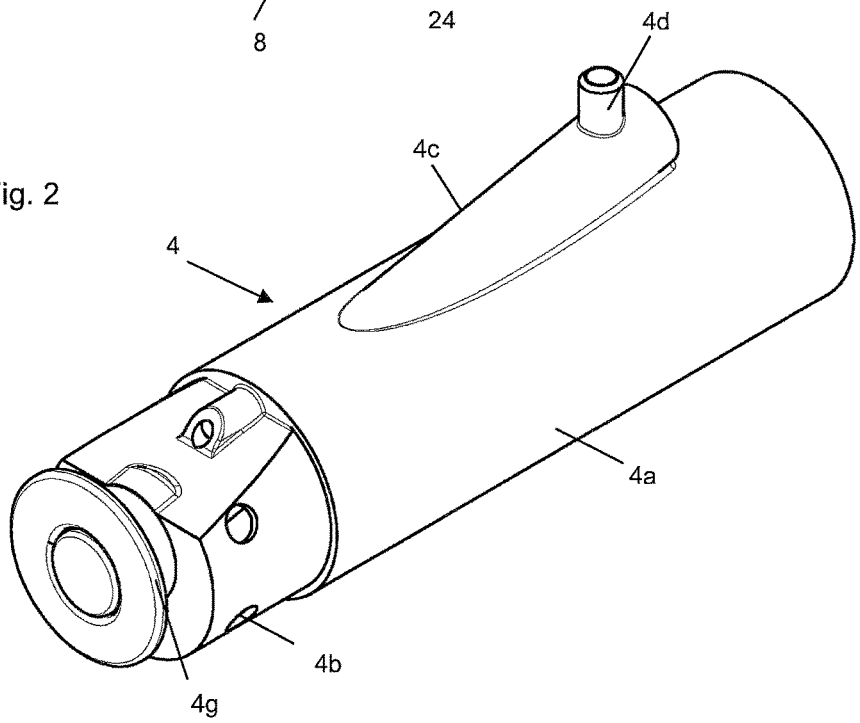
FIG. 2 shows a perspective view of the lance unit integrated into the flushing water connection.
Figure 3:
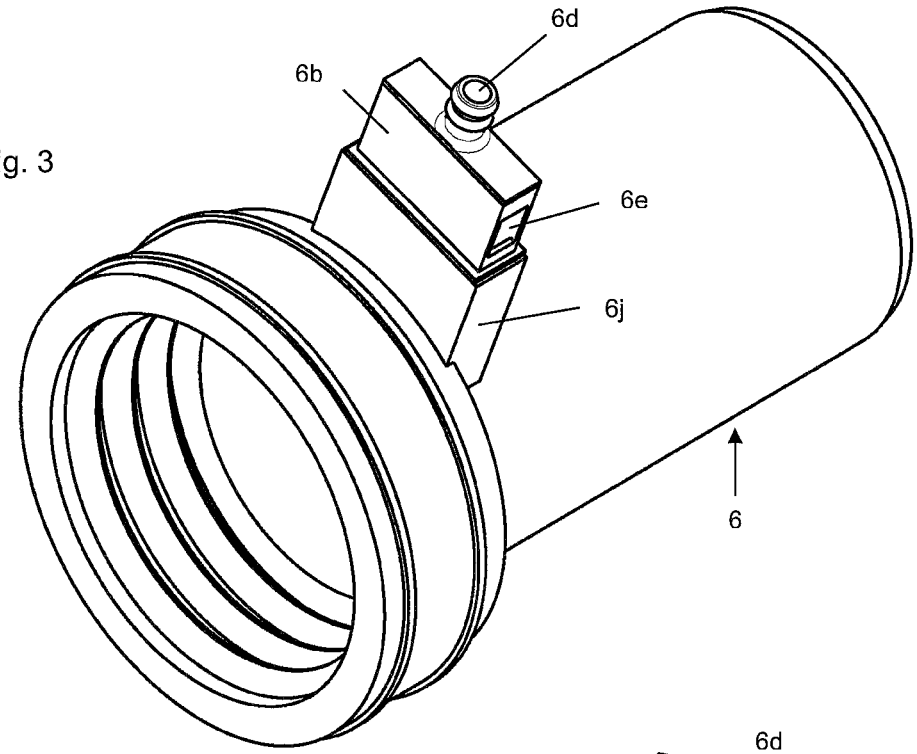
FIG. 3 shows a perspective view of a first embodiment of a drain connection according to the invention with integrated damage device.
Figure 4:
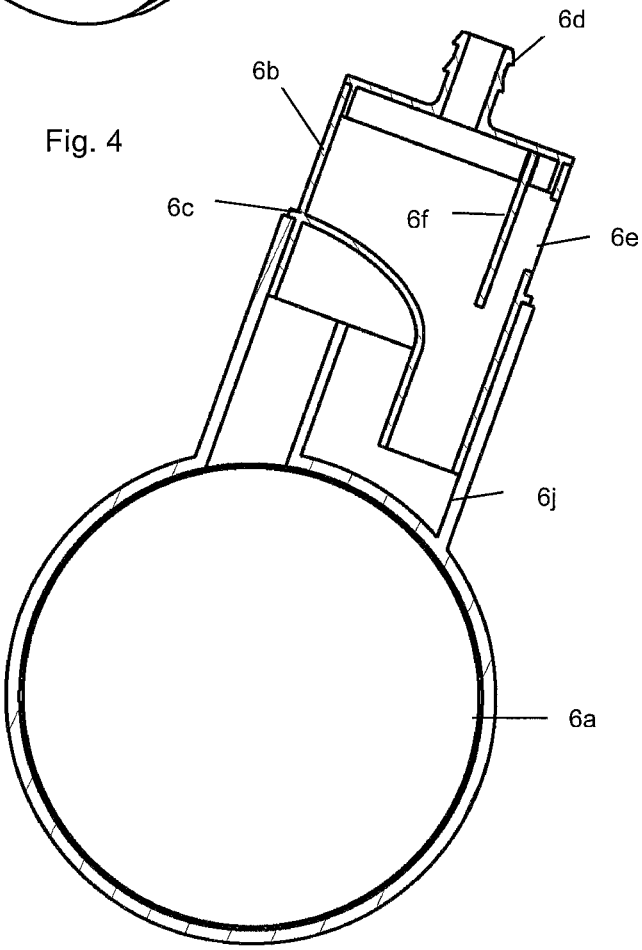
FIG. 4 shows a cross-section of the drain connection of FIG. 3 through the damage device.

A further aspect of the invention is the flushing water connection 4 shown in a perspective view in FIG. 2, with a preferably integrally integrated flushing lance. This comprises a substantially hollow-cylindrical flushing water connection portion 4*a* with a front end which can be inserted into the rear side of the toilet bowl 2, and a rear end which can be connected to a flushing pipe. The flushing water flows through the flushing water connection portion 4*a* out of the flushing water container in a flushing operation through a plurality of flushing openings 4*b* which are directed downwardly and to the side at the front end in the installation position, into the flushing chamber 2*a* of the toilet bowl 2. The inflowing flushing water is thus distributed in a ring-like or fan-shaped configuration to implement a flushing action which is over as full a surface area as possible, starting from the rear side and along the side surfaces of the flushing chamber 2*a* of the toilet bowl 2. The flushing performance can be adapted as required by modifying the arrangement of the flushing openings 4*b*. In a further development the jetting performance of those flushing water openings can also be adjusted and/or closed.

Formed in one piece at the top side of the flushing water connection portion 4*a* and formed integrally therewith as a one-piece injection molding is a cylindrical lance housing 4*c* of the flushing lance for longitudinally displaceably receiving a lance slider 4*e*, extending transversely relative to the longitudinal axis of the flushing water connection portion 4*a*. The longitudinal axis of the lance housing 4*c* or the lance slider 4*e* includes with the longitudinal axis of the flushing water connection portion 4*a* an angle of between 3 and 35 degrees, preferably 10 degrees. By adjusting the angle of inclination the flushing lance can be adapted to the respective circumstances of the WC bowl 2 when therefore the latter involves different geometrical configurations or when the flushing lance is intended to be caused to penetrate into the flushing chamber 2*a* to differing depths. In a development the lance housing includes an adjuster for adjusting the inclination of the lance housing 4*c* in relation to the longitudinal axis of the flushing water connection 4, for example by a knurled screw. At its end which is the rearward in the installation position the lance housing 4*c* has a connecting connection portion 4*d* for a separate fresh or drinking water line.

In a development the end position of the lance can also be adapted to be adjustable in order thereby to vary the position of the douche jet by varying the depth of penetration of the lance in the extension position. In a preferred solution that is effected by an adjustable abutment comprising a Bowden cable which is fixed to an operating element and is displaceable by way thereof.

When flushing water for performing personal flushing flows into the lance housing 4*c* by way of that connecting connection portion 4*d*, for example controlled by way of a cartridge, the water pressure of the inflowing flushing water drives the lance slider 4*e* arranged longitudinally displaceably in the lance housing 4*c* initially only forwardly, by virtue of an annular flange formed in one piece on the internal wall, against a compression spring 4*f* operative between the lance slider 4*e* and the front side of the lance housing 4*c*, so that the lance slider 4*e* issues through an opening in a union nut 4*g* into the flushing chamber 2*a* of the toilet. however as soon as the water can flow past the annular flange at that annular seal when the lance slider 4*e* is sufficiently driven forwardly in the passing chamber 4*h*, which is the case when the lance slider 4*e* is approximately half extended, the flushing water for performing the personal flushing operation passes out of the exit openings at the front side in the lance slider 4*e* of the flushing lance for performing personal flushing. The lance slider 4*e* is therefore initially extended by about half before personal intimate flushing occurs.

Provided at the upper rear end of the toilet bowl 2 is an upwardly projecting step 2*c* into which the rear end of the lance housing 4*c* and of the connecting connection portion 4*d* project in order to permit simple fitment of those elements. The height of the step 2*c* is no higher than the height of the fitted toilet lid in the closed condition and therefore fits harmonically into the overall design of the toilet. The step is also easy to clean as it is integrated throughout in one piece in the ceramic pan. By virtue of the low structural volume required however it is also basically possible for the invention to be carried out without such a step 2*c* in the toilet bowl 2.

For mounting, dismantling and/or maintenance of the flushing lance it is only necessary to remove the union nut 4*g*, the compression spring 4*f* and the lance slider 4*e*. In that way the flushing lance can be fitted and maintained even when the toilet is completely mounted, without removal thereof from the wall, and that represents a marked improvement over the state of the art.

Figure 5:
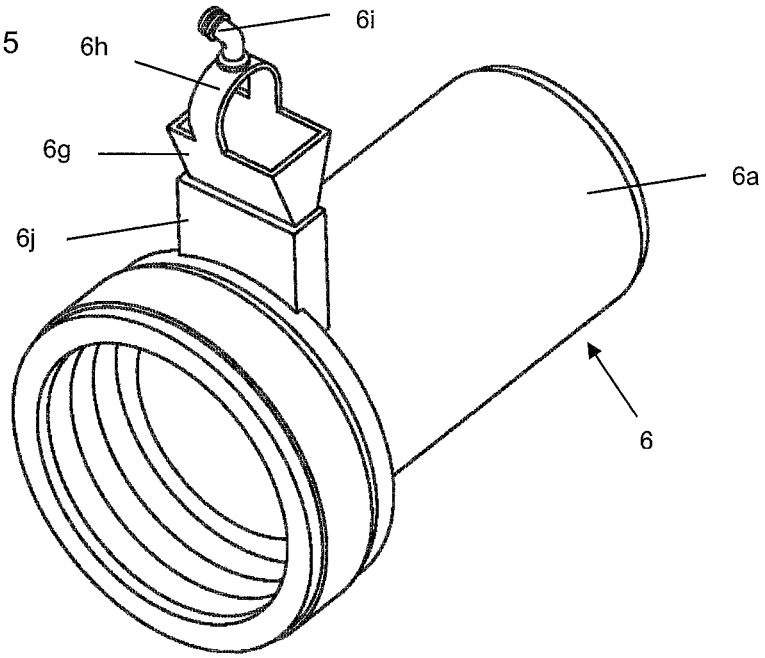
FIG. 5 shows a perspective view of a drain connection with a second embodiment of a damage device.
Figure 6:
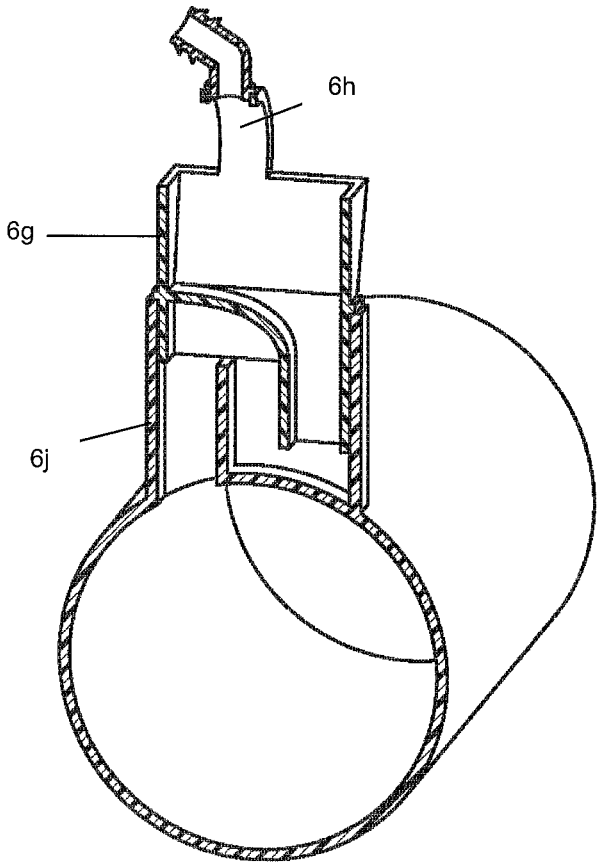
FIG. 6 shows a cross-section through the damage device of FIG. 5.

FIG. 5 shows a perspective view of a drain connection portion 6*a* with an alternative configuration of a damage device according to the invention. This also includes a receiving connection portion 6*j* which is rectangular in cross-section and into which however an insert element in the form of a funnel element 6*g* is now fitted. At its lower portion that funnel element 6*a* is of a configuration corresponding to the cross-section of the receiving connection portion 6*j* and from there enlarges conically upwardly to form a funnel of rectangular cross-section, which in the center includes a bridge hoop 6*h* which bridges over the entrance of the funnel in an arcuate configuration and at the top side of which there is in turn provided a connection nipple 6*i* for a drain hose (not shown). It is possible to connect to that connection nipple 6*i* the drain hose which with its other end for carrying away leakage water is connected to the injector for forming the DIN 1717 safeguard. The particular advantage of this configuration is that this connection can be designed as may be desired and can be passed even in the very constricted structural space within the toilet over prolonged distances, for example by a connecting hose, as long as there is a sufficient fall. That affords quite novel use options in terms of design configuration. In this embodiment also an odor trap in the form of a syphon or secondary syphon is provided in the damage device. Alternatively the funnel can also be of such a shape that it ends directly beneath the injector and leakage water can thus be removed directly, that is to say without an additional hose.

Various blockages (damage situations) can occur within a toilet, which could lead to unwanted back-suction into the drinking water line and all of these are effectively avoided by the invention.

Figure 7:
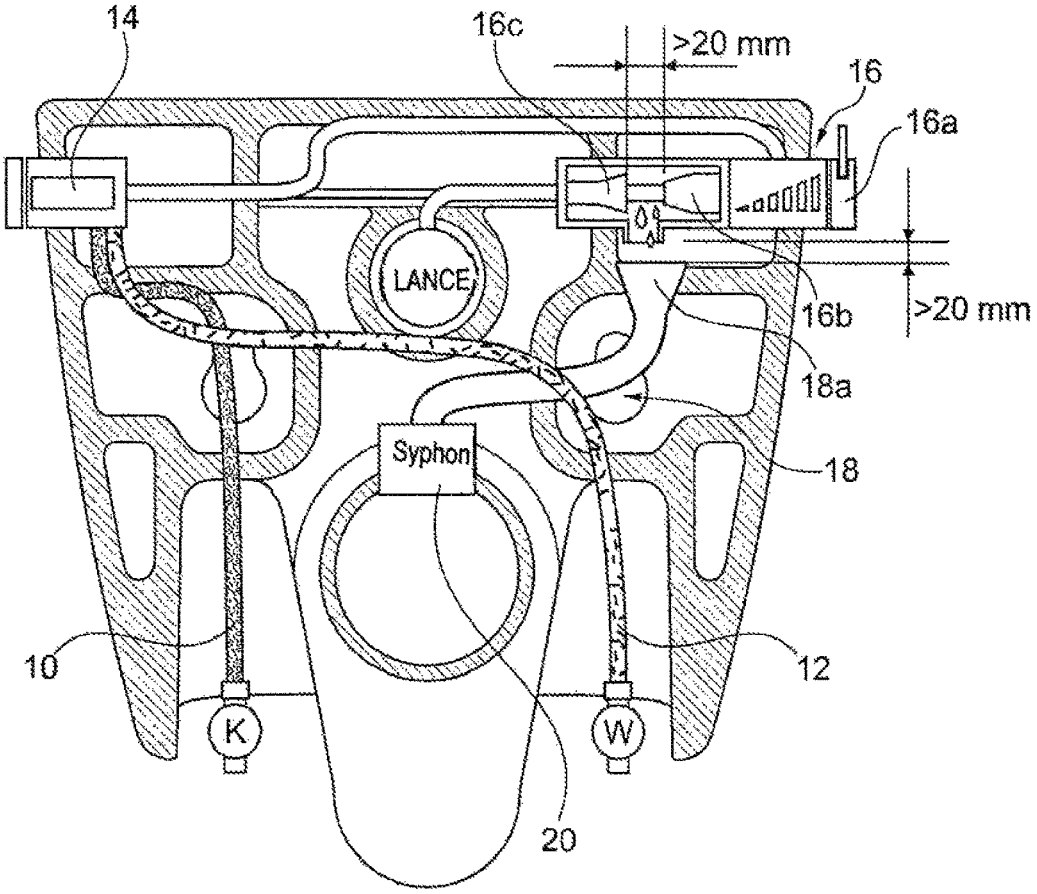
FIG. 7 shows a diagrammatic rear view of a douche toilet according to the invention with a thermostat cartridge and a DIN EN 1717 safeguard designed in accordance with the invention.

FIG. 7 shows a rear view of a douche toilet including a cold water conduit 10 and a separate warm water conduit 12 which are connected from separate angle valves to a regulatable thermostat 14. The mixed water from that thermostat 14 is fed to a rotational cartridge 16 by way of a mixed water conduit, which cartridge 16 is arranged at the side of the toilet bowl 2, that is opposite to the thermostat 14. That cartridge 16 includes a rotary regulator 16*a* which is arranged externally on the toilet bowl 2 and which regulates the issue of drinking water from a nozzle of an injector forming the DIN EN 1717 safeguard, after the cartridge 16. A catch funnel 16*c* is arranged at a spacing of about 2 cm in the axial direction along the longitudinal axis of the injector, in the injector, opposite the nozzle 16*b*, the funnel 16*c* being connected to the connecting connection portion 4*d* of the lance housing 4*c*. Arranged at a spacing of 2 cm beneath a leakage water outlet opening of the injector is the funnel-shaped damage opening 18*a* of a damage line 18 which is connected to the drain connection 6 by way of an interposed secondary syphon 20.

Figure 8:
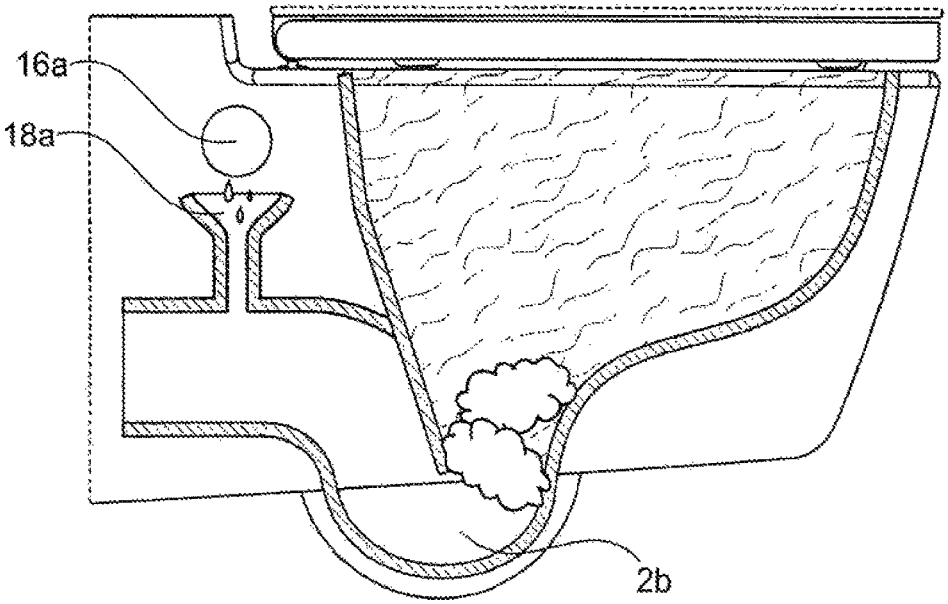
FIG. 8 shows a diagrammatic longitudinal section through a toilet for illustrating a first damage situation in a toilet with a blockage of the primary syphon.

Some of the possible damage situations are discussed hereinafter:

In the first damage situation shown in FIG. 8 the toilet or primary syphon 2*b* is blocked. By virtue of renewed flushing foul water rises in the flushing chamber to such a height that the toilet overflows. As the damage opening 18*a* of the safety device is disposed after the toilet syphon 2*b* leakage water can still flow away unimpeded. If back-suction should occur then air and not foul water is sucked into the drinking water line; the conditions of DIN EN 1717 are thus met.

Figure 9:
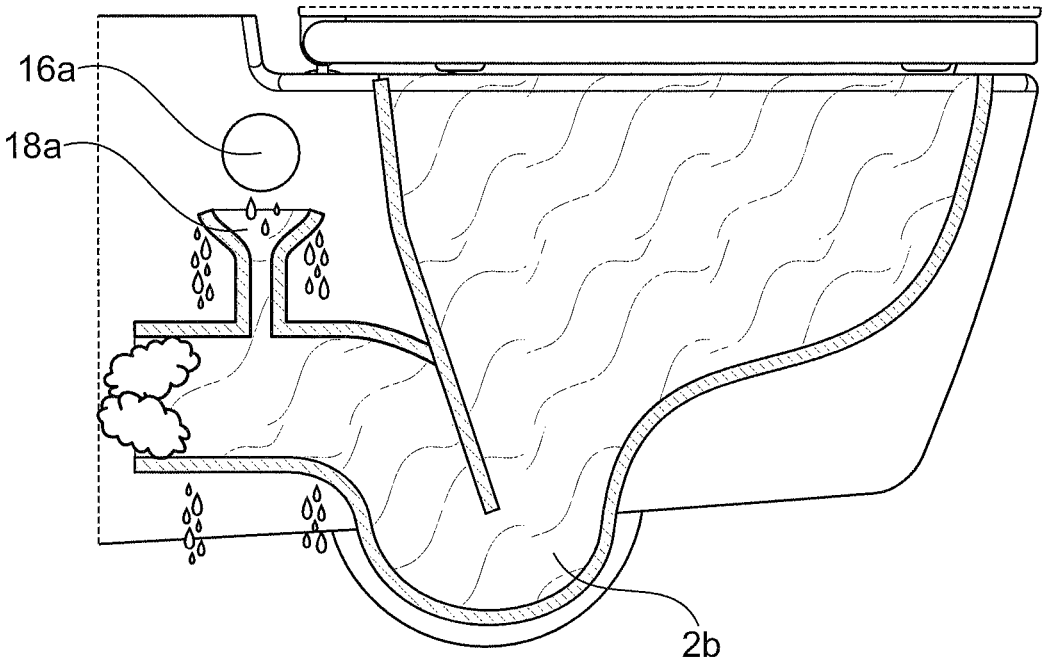
FIG. 9 shows a diagrammatic longitudinal section through a toilet for illustrating a second damage situation in a toilet with a blockage of the drain connection.

In the second damage situation shown in FIG. 9 the toilet is blocked after the primary syphon 2*b*. Although that situation occurs extremely rarely the safety device is also thereby not impeded in its mode of operation. More specifically, only foul water passes out of the damage opening 18*a* on to the floor. In the event of possible back-suction in this respect here too air and not foul water is drawn into the drinking water line. The highest possible water level at the damage opening 18*a* can be exactly ascertained. That arises out of the flow resistance of the damage line plus the associated secondary syphon 20 and the pressure which can occur due to the geodetic height difference between the upper edge of the toilet pan (flushing chamber) and the upper edge of the damage opening. Exactly determining that critical water level is important because the safety distance of 2 cm above the critical water level in accordance with DIN EN 1717 is always to be observed.

Figure 10:
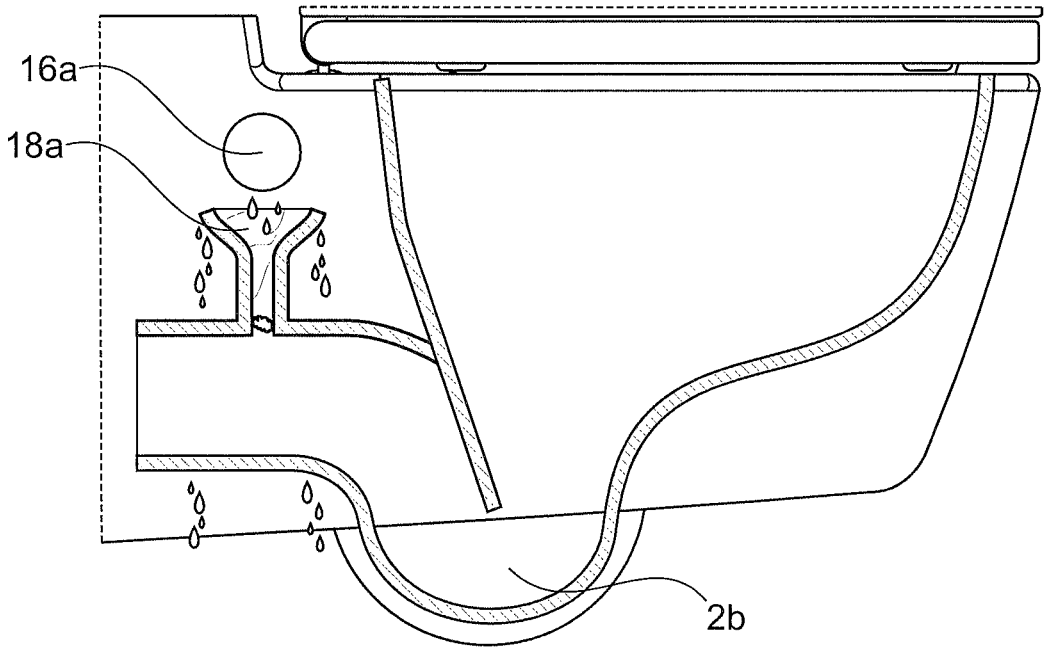
FIG. 10 shows a diagrammatic longitudinal section through a toilet for illustrating a third damage situation in a toilet with a blockage of the secondary syphon or the damage opening.

In the last damage situation as shown in FIG. 10 finally there is a blockage within the damage line 18 or the leakage water line. With that problem also leakage water passes into the room so that that problem is immediately visible. In the event of possible back-suction once again air and not foul water is sucked into the drinking water line. The back-suction safeguard in accordance with DIN EN 1717 is afforded in this case also.

Figure 11:
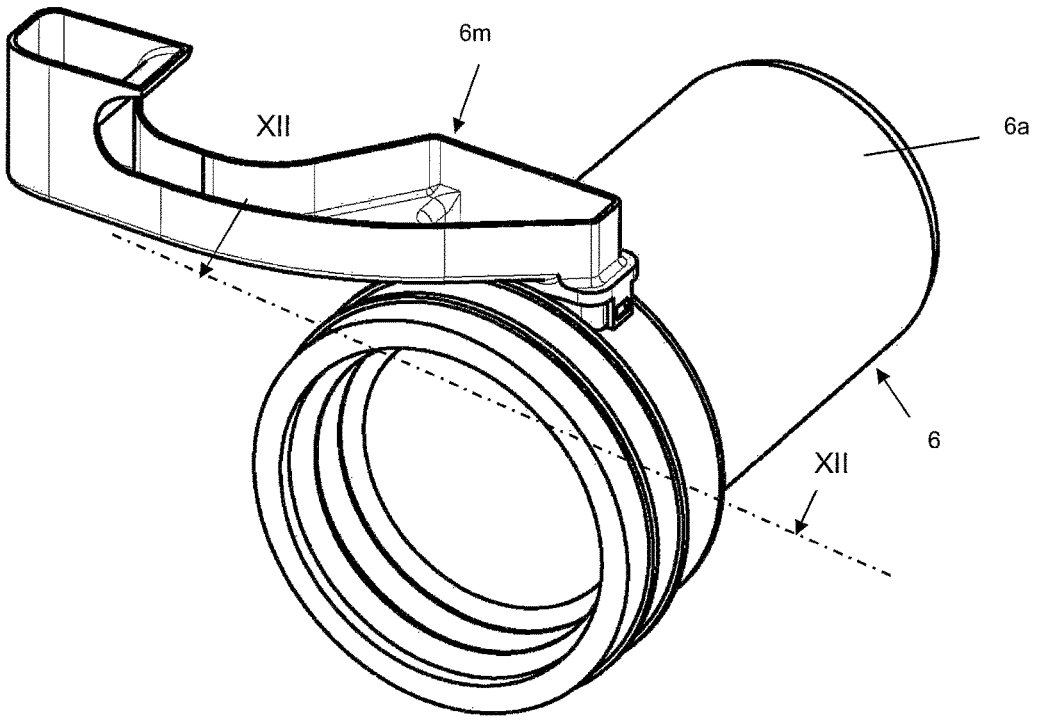
FIG. 11 shows a perspective view of a drain connection with a third embodiment of a damage device according to the invention.
Figure 12:
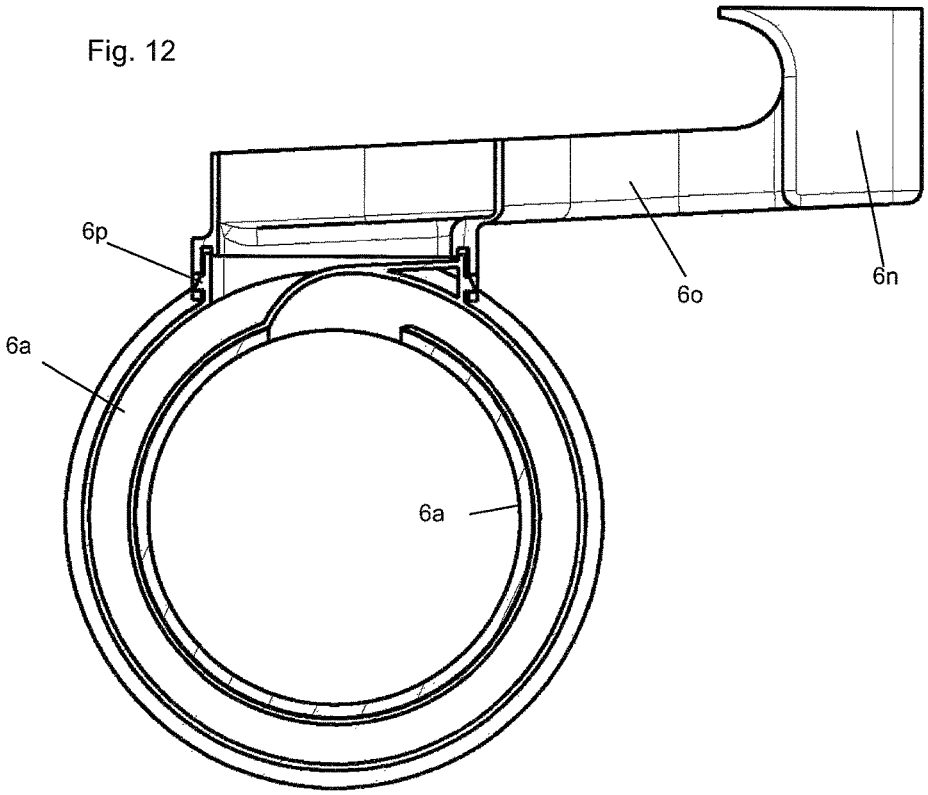
FIG. 12 shows a cross-section of the damage device along line XII-XII in FIG. 11.

The third embodiment shown in FIGS. 11 and 12 of the damage device according to the invention is designed in space-optimized fashion for installation in particularly constricted structural arrangements at the rear end of the toilet. In this embodiment the syphon is in the form of a ring syphon 6*k* which extends in a ring shape around the outer peripheral surface of the drain connection portion 6*a* and thus does not require any additional height. At the upper entry end the ring syphon 6*k* opens into the receiving connection portion 6*p* and at the upper exit end into a radial opening 6*l* at the end of the drain connection portion 6*a*, being the upper end in the installation position.

For catching and carrying the leakage water of the flushing lance an offset funnel 6*m* is sealingly fitted into the receiving connection portion 6*p*, which passes caught leakage water to the ring syphon 6*k* laterally displaced from the longitudinal axis of the drain connection portion 6*a*. That offset funnel 6*n* includes a transverse channel 6*m* which has a slight fall and which is of a channel-like configuration and extends in the installation position transversely relative to the longitudinal direction in which the drain connection portion 6*a* extends. At its lower end that transverse channel 6*n* is adapted for connection to the drain connection portion 6*a* and at its upper end—at the right-hand side in the Figures—it has a laterally enlarged funnel 6*o* for catching leakage water. In the installation position the funnel 6*o* is beneath the flushing lance or douche lance, and therefore catches any leakage water which possibly issues and passes same by way of the ring syphon 6*k* to the drain connection 6.

In the present embodiment the offset funnel 6*m* is provided at a lower end with an insert connection portion for sealing insertion in the receiving connection portion 6*p*, and can therefore be releasably fixed to the receiving connection portion and includes at both sides at the ends latching tongues for releasable fixing in the installation position. That releasable connection between the offset funnel 6*m* and the drain connection portion 6*a* that it is possible to implement simple adaptation to different toilet bowls or toilet pans by using different offset funnels 6*m*.

The invention therefore provides a douche toilet which is operable only by way of water, that is to say in power-less mode, wherein the douche functionality can be integrated into a normal toilet pan by virtue of the compact structure. Thus for the first time there is provided a particularly compact and inexpensive douche toilet without a technical box or unit behind the toilet bowl while complying with the requirements of DIN EN 1717.

The subject-matter of the present invention arises not just out of the subject-matter of the individual claims but from the combination of the individual claims with each other. All features and details disclosed in the documents—including the Abstract—in particular the spatial configuration illustrated in the drawings, are claimed as essential to the invention insofar as they are novel individually or in combination over the state of the art.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A douche toilet comprising a toilet bowl having a flushing water connection for feeding flushing water into a flushing chamber defined by the toilet bowl, having a lower end and an upper end delimited by a toilet opening, a drain connection including a primary odor trap for carrying away waste water from the flushing chamber in the course of a flushing operation, a personal cleaning device fed by way of a drinking water line for performing personal cleaning in respect of a user, as well as a safety device for safeguarding a drinking water line, the safety device including a damage opening arranged below an upper edge of the toilet opening.

2. A douche toilet as set forth in claim 1, wherein the damage opening comprises a funnel-shaped configuration.

3. A douche toilet as set forth in claim 1, wherein the safety device comprises a connecting element designed to feed leakage or foul water to the damage opening.

4. A douche toilet as set forth in claim 3, wherein the connecting element comprises a hose.

5. A douche toilet as set forth in claim 1, wherein the safety device is arranged behind the primary odor trap.

6. A douche toilet as set forth in claim 1, wherein it includes an odor trap designed to suck odors from inside the toilet bowl.

7. A douche toilet as set forth in claim 5, wherein it includes a connection portion designed to connect the hose.

8. A douche toilet as set forth in claim 1, wherein the safety device is at least partially integrated into the drain connection.

9. A douche toilet as set forth in claim 1, wherein the safety device includes a ring syphon which extends around the drain connection and/or is integrated into same.

10. A douche toilet as set forth claim 1, wherein the safety device includes an offset to permit an offset of the damage opening from the drain connection.

11. A douche toilet as set forth in claim 10, wherein the offset is designed as an offset funnel having a transverse channel which in the installation position extends transversely relative to the longitudinal axis of the drain connection.

12. A douche toilet as set forth in claim 1, wherein the personal cleaning device includes a flushing lance which is moveable from a retracted rest position into an extension position disposed in the interior of the flushing chamber.

13. A douche toilet as set forth in claim 3, wherein the connecting element comprises a ring syphon which either surrounds a drain connection or is integrated into the same.

14. An offset funnel for catching leakage water from a drinking water or flushing water line supplying a personal cleaning device, on a douche toilet as set forth in claim 1, wherein it includes a funnel adapted to catch the leakage water, a transverse channel and a connecter for connection to the drain connection.

15. An offset funnel as set forth in claim 14, wherein the connecter includes an insert connection.

16. An offset funnel as set forth in claim 14, wherein the connecter includes a latch.

17. An offset funnel as set forth in claim 16, wherein the latch includes tongues.

18. A douche toilet as set forth in claim 5, wherein the safety device is designed as a syphon.

19. A douche toilet comprising a toilet bowl having a flushing water connection for feeding flushing water into a flushing chamber defined by the toilet bowl, having a lower end and an upper end delimited by a toilet opening, a drain connection including a primary odor trap for carrying away waste water from the flushing chamber in the course of a flushing operation, a personal cleaning device fed by way of a drinking water line for performing personal cleaning in respect of a user, as well as a safety device for safeguarding a drinking water line, the safety device including a damage opening arranged below an upper edge of the toilet opening;

wherein the safety device comprises a secondary syphon located behind a primary syphon; and wherein the safety device comprises a connecting element designed to feed leakage or foul water to the damage opening.

* * * * *